US011027964B2

(12) United States Patent
Plecis

(10) Patent No.: US 11,027,964 B2
(45) Date of Patent: Jun. 8, 2021

(54) SYSTEM FOR PREPARING A PERSONALIZED COMPOSITION USING PRESSURE

(71) Applicant: LinkedTech, Paris (FR)

(72) Inventor: Adrien Plecis, Bourg-la-Reine (FR)

(73) Assignee: LinkedTech, Paris (FR)

( * ) Notice: Subject to any disclaimer, the term of this patent is extended or adjusted under 35 U.S.C. 154(b) by 0 days.

(21) Appl. No.: 16/314,690

(22) PCT Filed: Jul. 4, 2017

(86) PCT No.: PCT/FR2017/051812
§ 371 (c)(1),
(2) Date: Jan. 2, 2019

(87) PCT Pub. No.: WO2018/007748
PCT Pub. Date: Jan. 11, 2018

(65) Prior Publication Data

US 2019/0225479 A1 Jul. 25, 2019

(30) Foreign Application Priority Data

Jul. 4, 2016 (FR) ..... 1656381

(51) Int. Cl.
*B67D 7/02* (2010.01)
*B01F 15/02* (2006.01)
*B01F 13/10* (2006.01)

(52) U.S. Cl.
CPC ..... *B67D 7/0238* (2013.01); *B01F 13/1058* (2013.01); *B01F 13/1063* (2013.01); *B01F 15/0238* (2013.01)

(58) Field of Classification Search
CPC ..... B67D 7/0238; B01F 13/1063; B01F 13/1058; B01F 15/0238
See application file for complete search history.

(56) References Cited

U.S. PATENT DOCUMENTS 3,557,077 A 1/1971 Brunfeldt et al.
4,147,284 A * 4/1979 Mizzi ..... B05B 9/0822 222/401
5,568,885 A 10/1996 Green
5,950,867 A * 9/1999 Martindale ..... B67D 7/02 222/1

(Continued)

FOREIGN PATENT DOCUMENTS

DE 10 2005 023410 11/2006
EP 1 421 997 5/2004

(Continued)

*Primary Examiner* — Frederick C Nicolas
(74) *Attorney, Agent, or Firm* — Clark & Brody LP

(57) ABSTRACT

A preparation and dispensing system prepares and dispenses a personalized composition from N reserves (501-502) of active compounds (A1-A2), N being an integer greater than or equal to 1, which is accurate, quick, easy to implement, hygienic and economical. The system comprises a pneumatic-pressure generator (200) connected to a pressure distributor (300) comprising N pressure changeover switches (301-306), each one having at least one inlet (I1) connected to the pressure generator, one inlet (I2) connected to atmospheric pressure and an outlet (311-316) connected to an inlet of a reserve of active compound.

27 Claims, 7 Drawing Sheets

(56) References Cited

U.S. PATENT DOCUMENTS

| | | | | |
|---|---|---|---|---|
| 6,021,921 | A | 2/2000 | Lan et al. | |
| 7,172,096 | B2 * | 2/2007 | O'Dougherty ..... | B67D 7/0261 222/1 |
| 8,424,723 | B2 * | 4/2013 | Doelman ..... | B67D 1/0082 222/105 |
| 2003/0080142 | A1 * | 5/2003 | Meheen ..... | B67D 1/0884 222/1 |
| 2005/0224523 | A1 * | 10/2005 | O' Dougherty ..... | B67D 7/0261 222/399 |
| 2006/0102652 | A1 | 5/2006 | O'Dougherty | |

FOREIGN PATENT DOCUMENTS

| | | |
|---|---|---|
| FR | 3 044 219 | 6/2017 |
| JP | 2006-143903 | 6/2006 |
| JP | 2008-178823 | 8/2008 |
| WO | 85/01224 | 3/1985 |
| WO | 2004/104524 | 12/2004 |
| WO | 2008/141206 | 11/2008 |
| WO | 2009/068054 | 6/2009 |
| WO | 2014/080093 | 5/2014 |

* cited by examiner

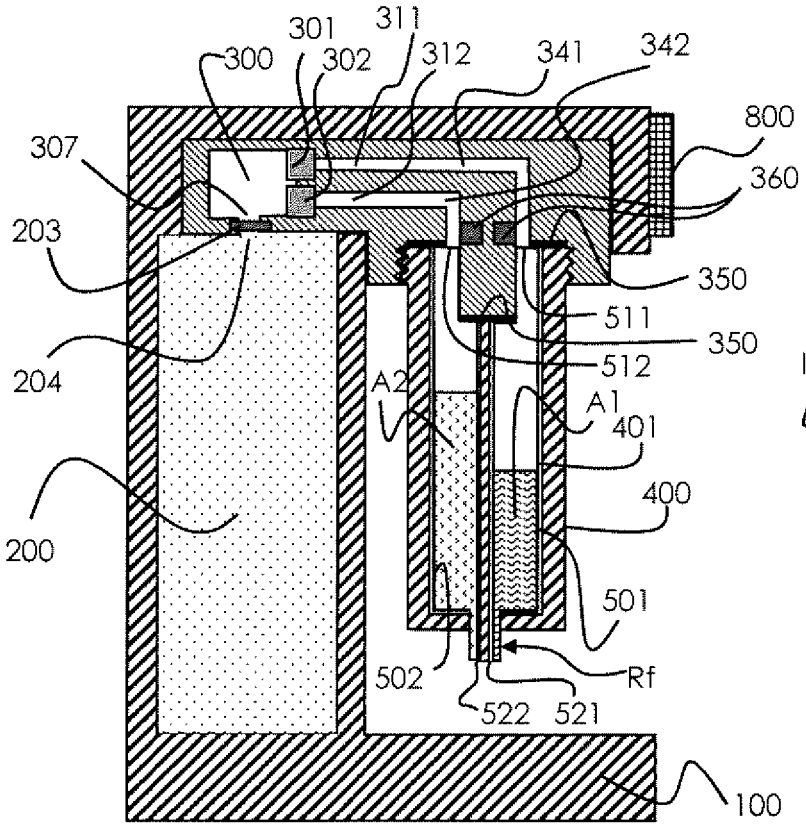
Fig. 1
Fig. 2a
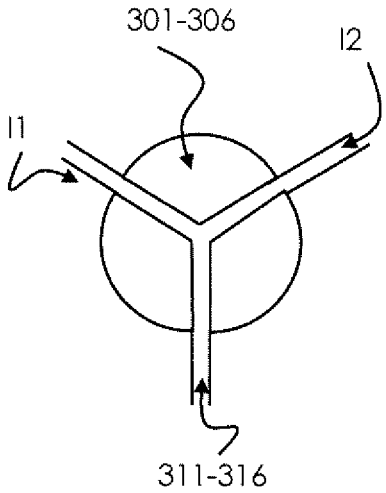
Fig. 2
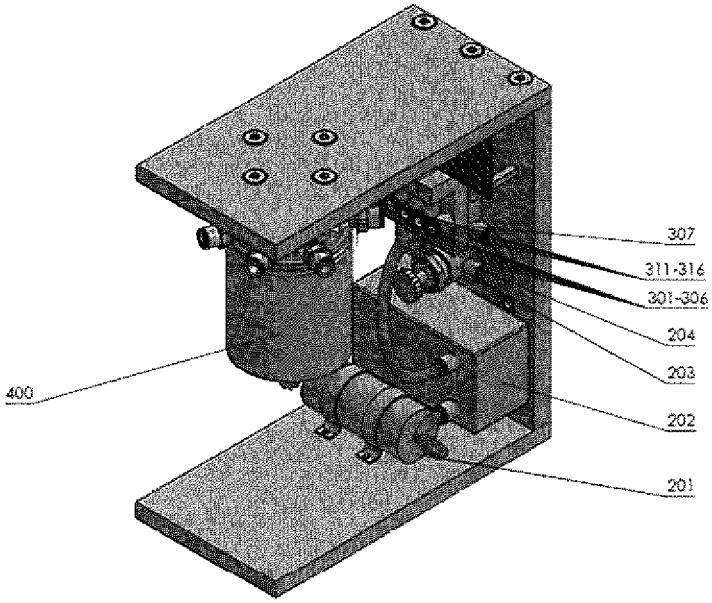
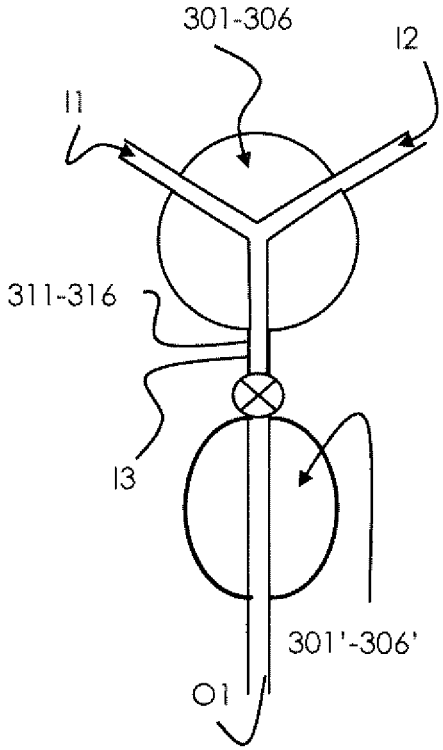
Fig. 2c

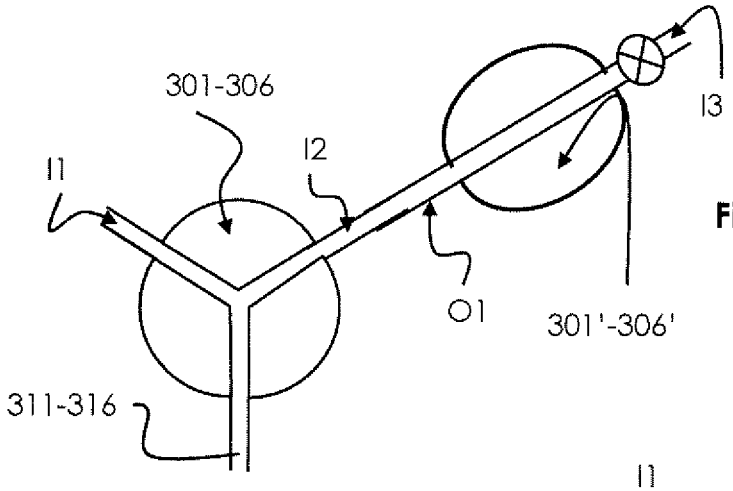
Fig. 2b
Fig. 2d
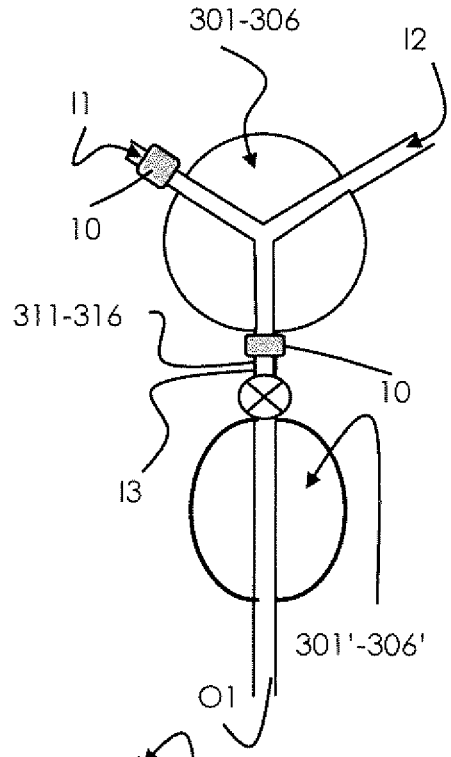
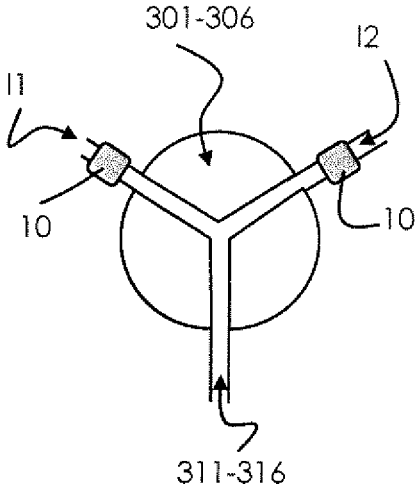
Fig. 2f
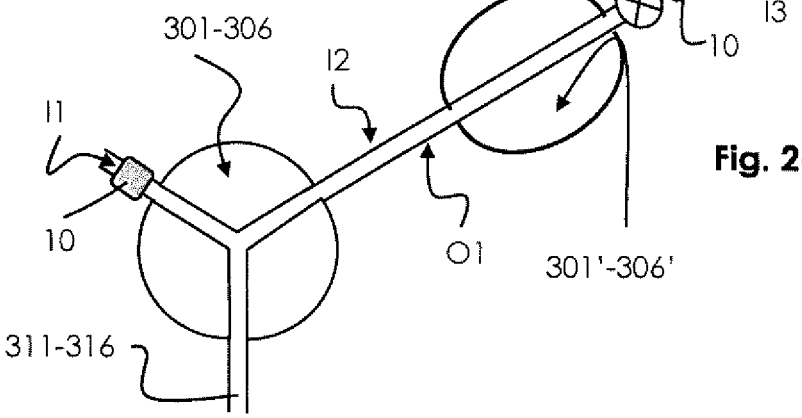
Fig. 2e

Fig. 2g
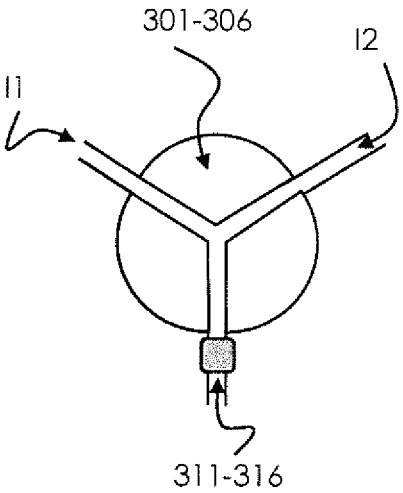
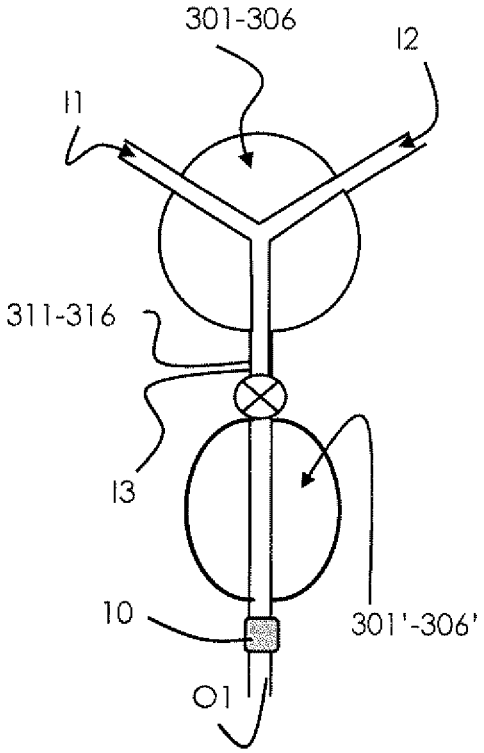
Fig. 2i
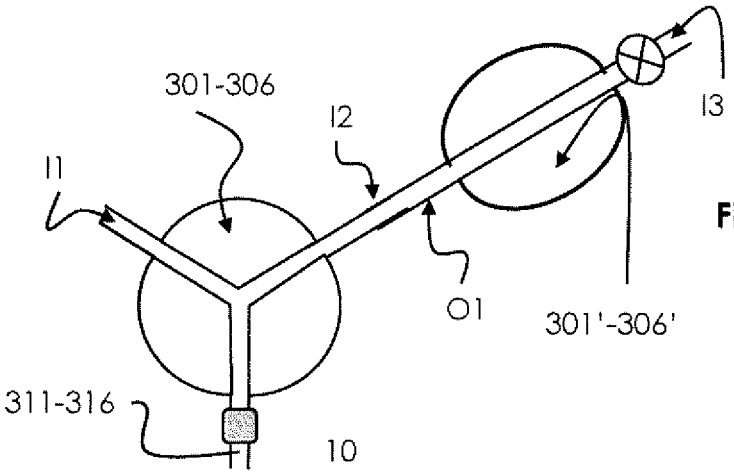
Fig. 2h

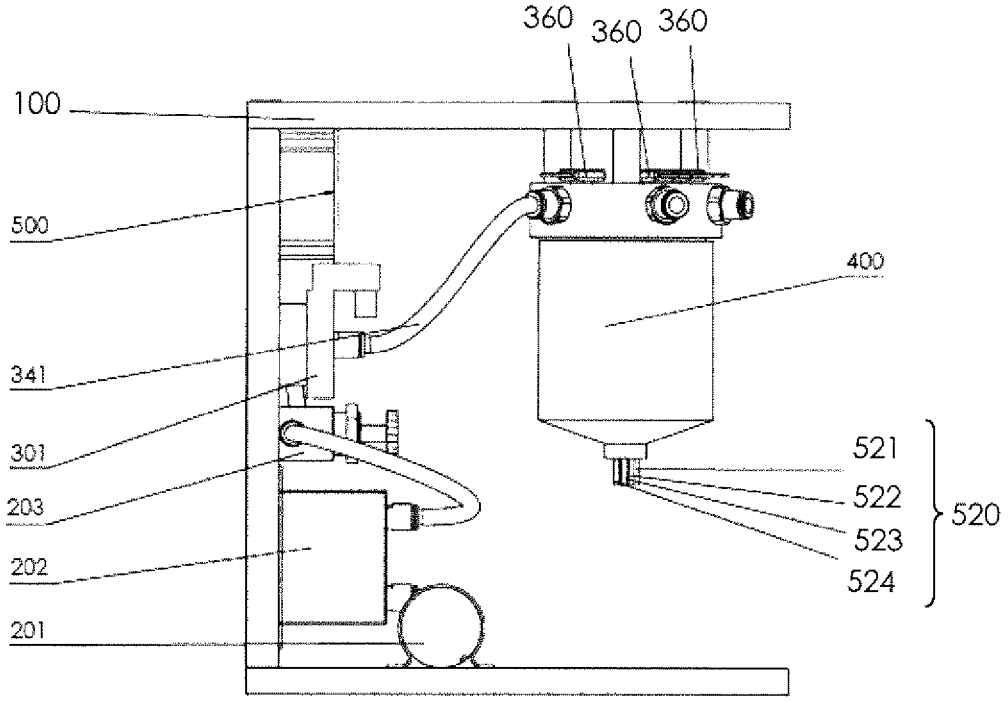
Fig. 3
Fig. 4
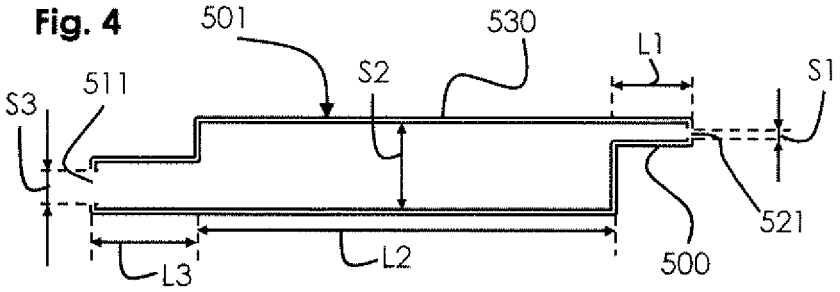

Fig. 5
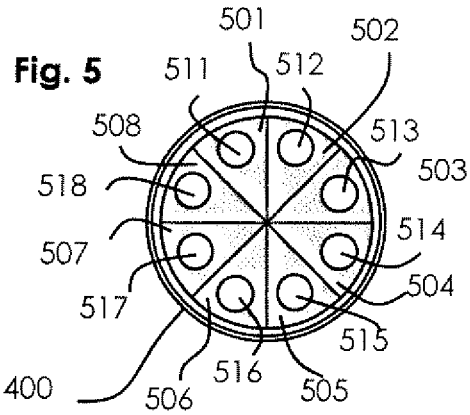
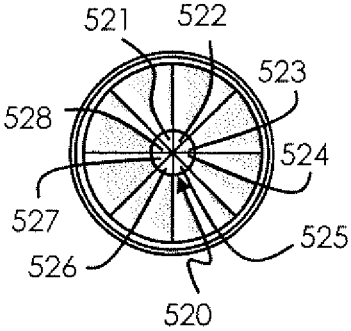
Fig. 6a
Fig. 6b
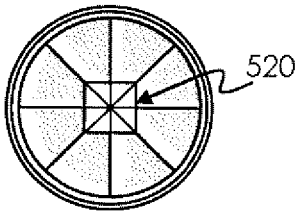
Fig. 6c
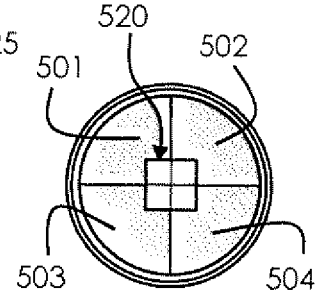
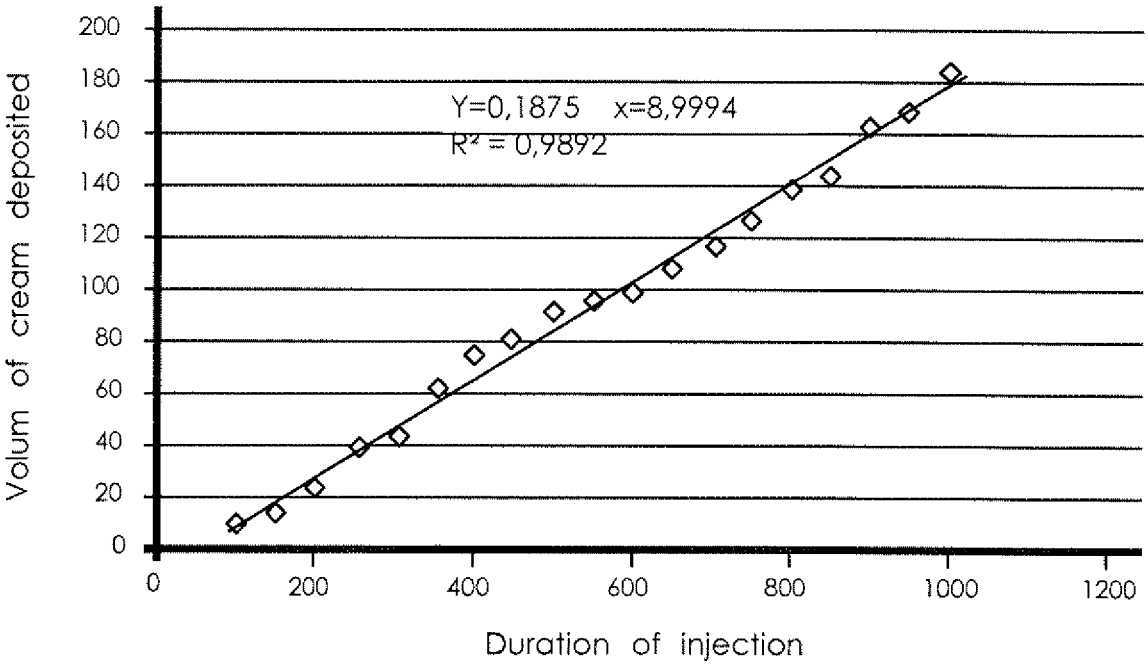
Fig. 7

SYSTEM FOR PREPARING A PERSONALIZED COMPOSITION USING PRESSURE

FIELD OF THE INVENTION

The invention relates to a system for preparing a personalized composition using pressure.

TECHNICAL BACKGROUND

Industry is increasingly tending to favour the manufacture of items by the user himself from data transmitted via the Internet and implemented by connected manufacturing systems such as 3D printers.

At the same time, in the field of consumable items, we are seeing a tendency to personalize products according to the end-user. This tendency is seen, for example, in the preparation of pharmaceutical treatments specifically tailored to the patient according to his gender, his age, his genetic inheritance and the specifics of his illness, such as his cancer or the viral strain.

The invention seeks to propose a system for preparing personalized compositions in the field of consumable items such as cosmetic preparations (dermatological/skincare and haircare products, etc.), therapeutic treatment products, nutrition (preparation of personalized flavoured or vitamin-enriched beverages), arts and crafts (preparation of personalized paints), household products (washing soap, room scents, dishwashing products, cleaning products).

The present invention seeks to offer a device for preparing and dispensing a personalized composition from around a high number (several thousand/million/billion) of possible preparations from a restricted number of active ingredients, that is easy to implement, accurate and inexpensive.

In the field of cosmetics, such devices have already been proposed but have numerous disadvantages.

Patent document FR1570080 (published under number FR3044219) describes an automated device comprising a control interface controlling syringe drivers that cause the content of the syringes to be injected into flexible tubes that meet in a mixing zone made up of a multi-inlet connector connected to an ejection cone via which the cosmetic composition thus prepared is ejected.

The duration for which the syringe drivers are actuated and their rate of actuation depend on the quantity of cosmetic composition desired, on the proportion of the various active ingredients and cosmetic bases in the cosmetic formulation, and on the volume that lies between the connector and the ejection cone (the dead volume).

However, the use of syringe drivers makes the machine very expensive in terms of costs. Because each syringe driver is a positive-displacement actuator, the presence of a potential bubble cannot be detected and the dose administered may be insufficient. Because there is a mixing zone downstream which applies a back-pressure, at least part of the dose of product may also be pushed back upstream as a result of the elasticity of the system, such that the compounds may become contaminated with the other compounds contained in the mixture.

Furthermore, in the case of highly viscous preparations, the elasticity of the system generates a significant lag between actuation of the syringe drivers and delivery of the product, making the system too long and increasing the risks of erroneous metering (for example: the user withdrawing the mixture before having received the final injected dose). Furthermore, the mixer suffers from a risk of contamination (creams being drawn back into the tubes or diffusion of active ingredients). Finally, the device described in that document includes a dead volume. Thus, with previous mixture remaining in the mixing zone, a quantity of possibly undesirable products left over from the previous mixture will be added to the current mixture.

Document WO2014080093 describes an automated device comprising a support for single-use cartridges containing the active compounds, a mixing unit for mixing the active compounds, a hollow needle able to pierce the cartridges, and means for sucking active component through the said hollow needle towards the mixing unit.

The use of single capsules forces the user to perform numerous manipulations, with the risk of error. It generates numerous costs (both financial and ecological) and the fact that the quantity administered per capsule cannot be changed limits the number of possible formulations.

In addition, the quantity prepared is relatively great and a large proportion may be wasted if not used up quickly.

Furthermore, the mixing unit is a positive-displacement actuator which means that the quantity of product delivered is sensitive to the presence of bubbles.

Finally, the mixing unit needs to be cleaned after each preparation, and this too generates rinsing waste, which the user has to manage and which increases the risk of the formation of biofilms and bacteriological contamination. In addition, that document simply specifies that the unit is rinsed out with rinsing water, something which is completely inadequate for ensuring both hygiene and the accuracy of the products produced.

It is therefore currently not possible to produce a composition that is both extemporaneous and accurate to within one microlitre.

SUMMARY OF THE INVENTION

The invention seeks to solve the problems raised by the systems of the prior art and to allow more accurate and more rapid preparation and administration of a high number of formulations with a device that is easy to operate, hygienic, accurate, quick and economical.

By virtue of the preparation system according to the invention, it is possible to prepare single dose (one to several drops) of compositions from multi-use cartridges. Each cartridge contains at least one active compound, advantageously mixed with an excipient of the cream, oil, paste type or some other fluid. In the remainder of the description, the term "active compound" will be used to refer to the compound together with any excipient it might comprise.

To that end, one subject of the invention is a preparation and dispensing system for preparing and dispensing a personalized composition from N reserves of active compounds, N being an integer greater than or equal to 1, each one having a determined hydraulic resistance and each one comprising a fluid inlet, a fluid outlet and a body comprising at least one active compound, the system comprising a pneumatic-pressure generator connected to a pressure distributor comprising N pressure changeover switches, each one having at least one inlet connected to the pressure generator, one inlet connected to atmospheric pressure and an outlet connected to an inlet of a reserve of active compound, such that each reserve of active compound can be placed in communication either with atmospheric pressure, or with the pressure generated by the pressure generator.

A pressure changeover switch is a pneumatic control system having at least two inlets I1 and I2 and one outlet

311-316, the said changeover switch being controllable so as to apply to the outlet 311-316 a pressure the value of which is comprised between the two pressure values at the inlet I1 and at the inlet I2. It may for example be a 3:2 valve making it possible to apply to the outlet either the pressure from inlet I1 or the pressure from inlet I2. It may also be a controllable proportional regulator making it possible to apply to the outlet 311-316 any pressure comprised between the two pressure values at the inlet I1 and at the inlet I2.

The hydraulic resistance is a parameter that characterizes a pipe and makes it possible to calculate the loss of pressure head experienced by a fluid flowing along the pipe. The hydraulic resistance of the reserve of active compound is dependent on the structure of the reserve and on the viscosity of the active compound it contains. This flow resistance Rh of a fluidic portion is commonly defined by the proportionality relationship DeltaP=Q*Rh, where DeltaP is the pressure difference between the inlet and the outlet of the fluidic portion, Q is the flowrate of liquid flowing through this fluidic portion. This definition commonly applies to incompressible fluids and the flow resistance may thus be defined relative to a mass flowrate or volumetric flowrate, by means of the density of the active compound considered.

According to particular embodiments:

- each reserve of active compound may comprise, at its fluid outlet, an ejection nozzle the hydraulic resistance of which is at least nine times higher than the hydraulic resistance of the said reserve of active compound;
- the ejection nozzle may be a cylindrical tube;
- each pressure changeover switch may be a 3:2 valve;
- each pressure changeover switch may be a pressure regulator;
- each reserve of active compound may be made up of an interchangeable multi-dose cartridge and of a cartridge support designed to keep, in use, hermetically and independently, each cartridge inlet with an outlet of a pressure changeover switch;
- the ejection nozzles may be arranged directly at the outlet of each cartridge;
- the ejection nozzles may be arranged on the support in such a way that, in use, they are arranged downstream of the outlet of the cartridges, and are designed to be held hermetically, in use, against each cartridge outlet;
- the pneumatic-pressure generator may be made up of a pump connected to a pressure reservoir itself connected to a pressure reducer allowing the reservoir outlet pressure to be regulated;
- the pneumatic-pressure generator may be made up of a removable and interchangeable compressed-gas reservoir associated with a pressure reducer;
- the inlet of at least one pressure changeover switch may be connected to an outlet of a 2:2 valve further comprising a controllable-opening inlet connected to atmospheric pressure such that at least one reserve of active compound can be either placed in communication with atmospheric pressure or placed in communication with the pressure generated by the pressure generator, or closed;
- the outlet of at least one pressure changeover switch may be connected to a controllable-opening inlet of a 2:2 valve further comprising an outlet connected to a reserve of active compound, such that at least one reserve of active compound can be either placed in communication with atmospheric pressure, or placed in communication with the pressure generated by the pressure generator, or closed;
- the system may comprise N pressure sensors each one arranged in a reserve of active compound, allowing the pressure in the N reserves of active compound to be measured;
- a flow limiter may be arranged between the pressure generator and each inlet of the N pressure changeover switches;
- a flow limiter may be arranged between atmospheric pressure and each inlet of the N pressure changeover switches;
- a flow limiter may be arranged between each reserve of active compounds and each outlet of the N pressure changeover switches;
- the system may further comprise N' so-called "reference" reservoirs which are hermetic and nondeformable in operation under pressure and have known and mutually different volumes, N' being greater than or equal to 1, the pressure distributor having N' additional pressure changeover switches connected to the said reference reservoirs and each comprising a pressure sensor allowing the pressure internal to each reference reservoir to be measured;
- N+N' identical flow limiters may be arranged between the pressure generator and each inlet of the N+N' pressure changeover switches;
- N+N' identical flow limiters may be arranged between atmospheric pressure and each inlet of the N+N' pressure changeover switches; and/or
- N+N' identical flow limiters may be arranged between each reserve of active compounds and each outlet of the N+N' pressure changeover switches.

Another subject of the invention is a cartridge for a preceding preparation and dispensing system, the cartridge comprising a body, an inlet and an outlet fitted with an ejection nozzle the hydraulic resistance of which is at least nine times higher than the hydraulic resistance of the said body.

According to particular embodiments:

- the body may be delimited by a longitudinal wall, the ejection nozzle being positioned in the continuation of the longitudinal wall of the body of the cartridge such that, in use, when several cartridges are juxtaposed, the outlets of the cartridges together form a single distribution nozzle; and/or
- the cartridge may comprise an exterior wall that is nondeformable by the pressure in operation, and an internal chamber comprising the active compound(s), the said chamber being deformable under the pressure in operation and being intended to be fixed in a sealed manner to the ejection nozzle in the position of use.

Another subject of the invention is a method for preparing and dispensing a personalized composition from reserves of active compounds of a preceding system, the method comprising the following steps:

a) activating the pneumatic-pressure generator to deliver a working pressure;
b) controlling activation of the N pressure changeover switches for a determined duration so as to deliver a working pressure for a given time to at least one reserve of active compound and deliver, for each active compound a dose determined according to the working pressure;
c) at the end of each determined duration, controlling activation of the N pressure changeover switches to deliver atmospheric pressure to the said at least one reserve of active compound in order to stop the flow of active compound out of the said at least one reserve.

According to particular embodiments:

during step b), the duration for which each active compound is dispensed may be recorded, the quantity of active compound dispensed from each reserve then being deduced and used to determine a fill status for each reserve, the method further comprising a step d) of indicating a need to refill the reserves;

when the system comprises an ejection nozzle the hydraulic resistance of which is at least nine times higher than the hydraulic resistance of the said reserve of active compound, and pressure sensors in the reserves of active compounds, the method may further comprise a step of determining the dose of active compound dispensed, comprising:

recording the curve of pressure measured by the pressure sensor as the pressure in the said reserve of active compound rises, stabilizes and falls;

integrating, with respect to time, the pressure thus measured;

calculating the injected dose by dividing the integral thus obtained by the hydraulic resistance;

when the system comprises pressure sensors in the reserves of active compounds, the method may further comprise a step of determining the degree of filling of at least one reserve of active compound, comprising:

recording the curve of pressure measured by the pressure sensor as the pressure in the said reserve of active compound rises and/or falls;

calculating the degree of filling of the said reserve of active compounds by comparing the curve of pressure thus measured against reference curves for the rise and/or fall of pressure in reservoirs having different degrees of filling;

when the system comprises pressure sensors in the reserves of active compounds, and N' reference reservoirs also fitted with pressure sensors, the method may further comprise a step of determining the degree of filling of at least one reserve of active compound, comprising:

recording the curve of pressure measured by the pressure sensor as the pressure in the said reserve of active compound rises and/or falls;

recording the curve of pressure measured by the pressure sensor as the pressure in each reference reservoir rises and/or falls;

calculating the degree of filling of the said reserve of active compounds by comparing the curves of the rise and/or fall of pressure in the said reserve of active compound against curves of the rise and/or fall of pressure in the reference reservoirs.

DESCRIPTION OF THE FIGURES

Further features of the invention will be listed in the following detailed description, given with reference to the attached drawings which respectively depict:

FIG. 1: a schematic view in cross section of a system for preparing and dispensing a personalized composition according to the invention;

FIG. 2: a schematic perspective view of a second embodiment of a system for preparing and dispensing a personalized composition according to the invention;

FIG. 2*a*: a schematic plan view of a 3:2 valve used as pressure changeover switch in a system for preparing and dispensing a personalized composition according to the invention;

FIG. 2*b*: a schematic plan view of a 3:2 valve combined with a 2:2 valve on the outlet, used as a pressure changeover switch in a system for preparing and dispensing a personalized composition according to the invention;

FIG. 2*c*: a schematic plan view of a 3:2 valve combined with a 2:2 valve on the inlet at atmospheric pressure, used as a pressure changeover switch in a system for preparing and dispensing a personalized composition according to the invention;

FIG. 2*d*: a schematic plan view of a 3:2 valve with inlet flow limiters used as pressure changeover switch in a system for preparing and dispensing a personalized composition thereof according to the invention;

FIG. 2*e*: a schematic plan view of a 3:2 valve with inlet flow limiters combined with a 2:2 valve on the outlet, used as a pressure changeover switch in a system for preparing and dispensing a personalized composition according to the invention;

FIG. 2*f*: a schematic plan view of a 3:2 valve with inlet flow limiters combined with a 2:2 valve on the inlet at atmospheric pressure, used as a pressure changeover switch in a system for preparing and dispensing a personalized composition according to the invention;

FIG. 2*g*: a schematic plan view of a 3:2 valve with an outlet flow limiter used as pressure changeover switch in a system for preparing and dispensing a personalized composition according to the invention;

FIG. 2*h*: a schematic plan view of a 3:2 valve with an outlet flow limiter combined with a 2:2 valve on the outlet, used as a pressure changeover switch in a system for preparing and dispensing a personalized composition according to the invention;

FIG. 2*i*: a schematic plan view of a 3:2 valve with an outlet flow limiter combined with a 2:2 valve on the inlet at atmospheric pressure, used as a pressure changeover switch in a system for preparing and dispensing a personalized composition according to the invention;

FIG. 3: a schematic side view of the system for preparing and dispensing a personalized composition of FIG. 2;

FIG. 4: a schematic view in longitudinal section of one example of a cartridge of active compound according to the invention;

FIG. 5: a schematic view from above of a set of cartridges with which a system for preparing and dispensing a personalized composition according to the invention is equipped;

FIGS. 6*a*, 6*b* and 6*c*: schematic views from beneath of three embodiments of a set of cartridges with which a system for preparing and dispensing a personalized composition according to the invention is equipped;

FIG. 7: a graph illustrating the linearity of the preparation volume deposited as a function of time using a system for preparing and dispensing a personalized composition according to the invention.

DETAILED DESCRIPTION OF THE INVENTION

Figure 8:
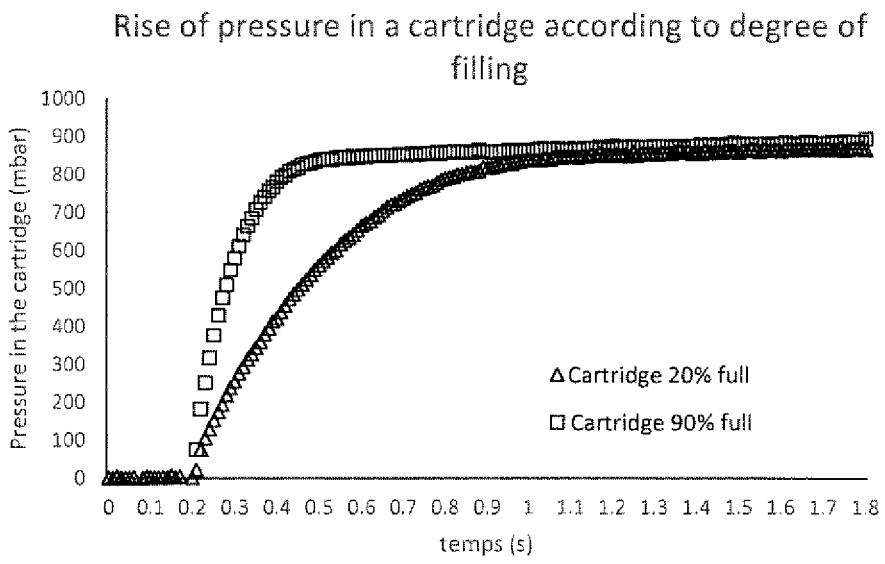
FIG. 8: a graph illustrating the duration of the rise in pressure of a cartridge of active compound as a function of its degree of filling.

In general, the system for preparing and dispensing a personalized composition according to the invention, illustrated in FIG. 1, comprises a support structure 100 comprising a pneumatic-pressure generator 200 connected to a pressure distributor 300 comprising N outlets, N being an integer greater than or equal to 1. N will be equal to 1 for dispensing a single product, for example for accurately dispensing a ready-prepared drug. N is greater than or equal to 2 for dispensing various products that need to be mixed.

Only two outlets 311-312 are illustrated in FIG. 1.

Each outlet can be controlled independently and is hermetically connected to a reserve of active compound.

The pressure distributor therefore has the function of distributing the pressure from the pressure generator between the various reserves of active compound. To that end, the pressure distributor 300 is made up of N pressure changeover switches 301-306 each comprising an outlet 311-312 allowing a zero pressure (no pressure arrives in the reserve of active compound to which the changeover switch in question is connected) to be switched over to a positive working pressure. Various types of pressure changeover switch may be used. The simplest is a 3:2 valve which has two positions: a closed position in which the pressure transmitted is atmospheric pressure, and an open position in which the pressure transmitted is the maximum of the pressure generator. Alternatively, it is possible to use a pressure regulator which makes it possible to transmit a pressure chosen from the interval comprised between atmospheric pressure and the maximum pressure.

Each reserve of active compound is fitted with an ejection nozzle on its fluidic outlet, on the opposite side to the compressed-air inlet. According to the invention, this ejection nozzle has a structure and dimensions which are such that the hydraulic resistance Rh1 of the ejection nozzle is very much higher than the hydraulic resistance Rh2 of the reserve of active compound. That allows for accuracy in the ejected dose. In practice, the hydraulic resistance Rh1 of the ejection nozzle is preferably chosen to be at least nine times higher than the hydraulic resistance Rh2 of the reserve of active compound.

In order to simplify the calculations in the remainder of the description, the ejection nozzles will be made up of a cylindrical tube of a cross section and length which are such that the hydraulic resistance Rh1 of the cylindrical tube is equal to preferably at least nine times the hydraulic resistance Rh2 of the reserve of active compound. However, the ejection nozzles (the cylindrical tubes) may also have internal structural arrangements that increase the hydraulic resistance for the same tube length. Alternatively, the ejection nozzles may have complex shapes, which means to say non-cylindrical shapes, such that the hydraulic resistance Rh1 of the nozzle is equal to preferably at least nine times the hydraulic resistance Rh2 of the reserve of active compound.

This relationship between the hydraulic resistances of the reserves and of the ejection nozzles at their fluid outlet ensures that the dose administered is proportional to the pressure applied irrespective of the level of filling of the cartridge.

Should the user prefer not to use an ejection nozzle, it is nonetheless necessary for him to know the hydraulic resistance Rh2 of the body of the cartridge and the degree of filling of the cartridge. This is because it will be possible to calibrate upstream the flowrate of active compound at the outlet of the cartridge according to the degree of filling thereof. In use, the fill level of the cartridge will be able to be extrapolated by integrating all of the doses already dispensed. In order to prepare and dispense a personalized composition from the reserves 501-508 of active compounds A1-A2, the user needs to:

a) activate the pneumatic-pressure generator 200, 201-202 to deliver a working pressure;

b) control activation of at least one of the N pressure changeover switches 301-306 for a determined duration so as to deliver a working pressure for a given time to at least one reserve of active compound and deliver, for each active compound A1-A2, a dose determined according to the working pressure; then c) at the end of each determined duration, control activation of at least one of the N pressure changeover switches 301-306 to deliver atmospheric pressure to the said at least one reserve of active compound in order to stop the flow of active compound out of the said at least one reserve.

Thus, when the user implements the invention with a full cartridge, initial knowledge of the hydraulic resistance Rh2 will make it possible to choose a dispensing time T=D*Rh2/DeltaP, where D is the required dose and DeltaP is the working pressure. By contrast, the error on the dose administered by the system will increase as the cartridge gradually empties. In the case of a vertical cylindrical cartridge, the error will for example reach 100% (twice as much dose administered) when the cartridge is half empty. It will therefore be necessary for the user to fill the cartridge regularly if this level of error is unacceptable for his purposes.

Another solution makes it possible to avoid this systematic and irksome filling which could also cause contamination of the active ingredient contained in the cartridge: during step b), the duration for which each active compound A1-A2 is dispensed is recorded, the quantity of active compound dispensed from each reserve 501-508 then being deduced and used to determine a fill status for each reserve 501-508. The system can then be programmed to display an indication that the reserves 501-508 need refilling.

Thus, it will also be possible for the system to extrapolate a new flow resistance according to the geometry of the cartridge. In the preceding example, after having registered the doses and observed that the cartridge is 50% empty, the system will for example be able to use a corrected reservoir resistance Rh2corr=50% Rh2. That will make it possible to significantly reduce the error on the administered dose particularly when successive doses are of small quantity in comparison with the total capacity of the cartridge.

However, this embodiment without an ejection nozzle with a resistance Rh1 at least 9 times higher than the resistance Rh2 will be particularly sensitive to the way in which the active compound spreads out in the cartridge. This is particularly critical in the case of highly viscous fluids such as cosmetic creams of which the distribution in the cartridge may vary following the administration of a dose over periods of several minutes, or even several hours. For this reason, it may be preferable, in order to ensure correct metering of the active compound, to introduce this ejection nozzle. In that case, the recording of the dispensing times and therefore of the successive doses in order to determine the level of filling of the cartridges is no longer indispensable for correctly predicting the administered dose. It may nevertheless be beneficial for checking the status of the system and predicting the critical level of filling below which it will be recommended that the user replace or refill the active cartridge.

All of the electrical or electronic elements are controlled by an electronic board which also, through a communication module, preferably wireless (Wi-Fi, Bluetooth, etc.) is able to collect the preparations that are to be dispensed. The supporting structure 100 may include a power supply system, a touchscreen 800 or any interface the user needs (button for switching on, selection, etc.) to operate the system.

In the embodiment illustrated in FIGS. 2 to 4, the pneumatic-pressure generator 200 may be made up of a pump 201 connected to a pressure reservoir 202, for example of 200 ml. This pressure generator is itself connected to a pressure reducer 203 that makes it possible to regulate the outlet pressure beyond atmospheric pressure, preferably at least 1 bar beyond.

Alternatively, the pressure generator may be made up of a removable and interchangeable compressed-gas reservoir, for example of the $CO_2$ canister type, associated with a pressure reducer 203.

The outlet of the pressure generator 204 is connected to the inlet 307 of a pressure distributor 300 via the pressure reducer 203. The pressure distributor 300 comprises a pneumatic circuit comprising an inlet 307 connected to the pressure generator 200 via the pressure reducer 203, and N pressure changeover switches 301-306 made up, for example, of valves 301-306 of 3:2 type (see FIG. 2*a*), and N flexible tubes 341-346 connecting the outlets 311-316 of the N pressure changeover switches 301-306 (or the N outlets O1 of possible 2:2 valves with which the pressure changeover switches may be equipped) to the reserves of active compounds 501-508.

These valves comprise an inlet I1 connected to the pressure generator, an inlet I2 connected to atmospheric pressure and an outlet 311-316 connected to a reserve 501-508 of active compound A1-A2 such that each reserve 501-508 of active compound A1-A2 may be placed in communication either with atmospheric pressure (in the absence of pneumatic thrust) or with the pressure generated by the pressure generator 200 (when pneumatic thrust is generated).

Alternatively, it may be preferable for the pressure distributor 300 to allow the pneumatic thrust in the reserve of active compound to be modulated by imposing a pressure that is somewhere between the pressure of the pressure generator and atmospheric pressure. In that case, use may be made of a controllable pressure regulator rather than of a 3:2 valve such that each reserve of active compound will be independently placed in communication with a pressure comprised between atmospheric pressure (absence of pneumatic thrust) and the pressure of the pressure generator (where maximum pneumatic thrust is generated).

Alternatively, it may be preferable for the pressure distributor 300 also to allow the outlets 311 to 316 to be isolated (closed). In other words, these outlets are neither at atmospheric pressure nor at the pressure of the pressure generator; they are simply closed.

For that, as illustrated in FIG. 2*b*, it is for example possible to associate a 2:2 valve with the atmospheric inlet I2 of each previous 3:2 valve. Thus, the inlet I2 of the 3:2 valve 301-306 is connected to an outlet O1 of a 2:2 valve 301'-306' further comprising a controllable-opening inlet I3 connected to atmospheric pressure. What is meant by controllable opening is an opening that can either be opened or closed.

Each reserve 501-508 of active compound A1-A2 can then either be placed in communication with atmospheric pressure or placed in communication with the pressure generated by the pressure generator, or closed.

An equivalent alternative is illustrated in FIG. 2*c* in which the 2:2 valve is arranged at the outlet 311-316 of the 3:2 valve. Thus, the outlet 311-316 of the 3:2 valve 301-306 is connected to a controllable-opening inlet I3 of a 2:2 valve 301'-306' further comprising an outlet O1 connected to a reserve 501-508 of active compound A1-A2.

In this way, each reserve 501-508 of active compound A1-A2 can be either placed in communication with atmospheric pressure or placed in communication with the pressure generated by the pressure generator, or closed.

Such embodiments make it possible to limit leaks of active compounds under the effect of gravity from the reserves of active compounds.

Alternatively, it is possible to use two 2:2 valves connected to one another rather than a 3:2 valve and a 2:2 valve. This is more economical.

Each outlet 311 to 316 of the pressure distributor 300 is connected to a reserve of active compound via the pressure changeover switches 301-306 using flexible tubes 341-342, for example having an internal diameter greater than 1 mm.

Advantageously, flow limiters can be used to control the rise in pressure (for ejecting active compound) and/or the fall in pressure (after ejection). This makes it possible to ensure a constant gas flowrate, for example of 50 l/min or 1 l/min, and make the rise and fall in pressure of the cartridges more repeatable and independent of the number of cartridges there are to be pressurized, of their degree of filling and of the pressurization capacity of the pressure generator.

As shown in FIGS. 2*d*-2*f*, in order to control the rise in pressure, a flow limiter is arranged at each inlet I1 of each pressure changeover switch 301-306 connected to the pressure distributor.

In order to control the fall in pressure, a flow limiter 10 is arranged at each inlet I2 (or I3) of each pressure changeover switch 301-306 connected to atmospheric pressure.

In order to limit both the rise and fall in pressure, it is possible either to arrange a flow limiter at the two inlets I1 and I2 (or at the inlet I3 of any 2:2 valve that may be fitted to the pressure changeover switch: see FIGS. 2*d*-2*f*) of each pressure changeover switch 301-306, or a flow limiter can be arranged at each outlet 311-316 of each pressure changeover switch 301-306 (or at the outlet O1 of any 2:2 valve there might be fitted to the pressure changeover switch; see FIGS. 2*g*-2*i*). FIGS. 2*d*-2*f* and FIGS. 2*g*-2*i* correspond to FIGS. 2*a*-2*c* but for the flow limiters.

The reserves of active compound advantageously comprise a support 400 equipped with N housings 401 and with N interchangeable multi-dose cartridges 501-502 each containing an active compound A1-A2, for example in the form of cream.

The support 400 is designed to hold, in use, hermetically and independently, each inlet 511-512 of a cartridge 501-502 with an outlet of the pressure distributor.

For example, the support is screwed to the supporting structure 100 in such a way that the cartridges 501-502 are pressed hermetically against a seal 350.

The seal 350 ensures that the pressure between the various cartridges is indeed independent and that there is no leakage between the support 400 and each cartridge.

The support comprises at least two housings for at least two cartridges so that a mixture of the active compounds A1-A2 contained in the cartridges can be produced.

For a cosmetic application, the support comprises at least four, preferably at least six, advantageously at least eight housings for, respectively, four, six or eight cartridges.

All of the electrical or electronic elements (the valves, the pump, the pressure sensors, the dose computer, etc.) are controlled by an electronic board which, via a communication module, preferably wireless (Wi-Fi, Bluetooth, etc.) allows the preparations that are to be dispensed to be collected. The supporting structure 100 may include a power supply system, a touchscreen 800 or any interface that the user needs (button for switching on, selection, etc.) to operate the system.

According to one preferred embodiment of the invention, illustrated in FIG. 4, each reserve of active compound comprises, at its fluid outlet, an ejection nozzle 500 the hydraulic resistance Rh1 of which is at least nine times higher than the hydraulic resistance of the said reserve of active compound.

Advantageously, the ejection nozzle is a cylindrical tube 500 arranged upstream of the fluidic outlet, on the opposite side to the compressed-air inlet. This cylindrical tube has a cross section S1 and a length L1 which are such that:

$$\frac{Rh2}{Rh1} < \frac{X}{(1-X)'}$$

where

Rh2 is the hydraulic resistance of the reserve of active compound;

Rh1 is the hydraulic resistance of the tube; and

X is the maximum acceptable percentage error between the flowrate called for in constant-pressure injection regime and the flowrate actually obtained in constant-pressure injection regime.

This equation can be simplified to Rh2/Rh1<X when the maximum percentage error X is small in comparison with 1.

Thus, if a maximum level of error of 10% is accepted, the ratio between the hydraulic resistance Rh1 of the cylindrical tube and the hydraulic resistance Rh2 of the cartridge needs to be higher than 9. It is preferably higher than 10. In other words, according to the invention, the hydraulic resistance Rh1 of the cylindrical tube is advantageously chosen to be at least nine times greater than the hydraulic resistance of the cartridge.

If the maximum level of error allowed is 1%, the ratio between the hydraulic resistance of the cylindrical tube and the hydraulic resistance of the cartridge is 100. In other words, the hydraulic resistance of the cylindrical tube needs to be 100 times greater than the hydraulic resistance of the cartridge.

The cross section may be circular, triangular, square or another shape. The examples given hereinafter are given for a circular cross section.

When the tube and the cartridge have a circular cross section, the ratio between Rh1 and Rh2 will take the form:

$$\frac{Rh1}{Rh2} = \frac{L1 * R2^4}{L2 * R1^4}$$

where:

Rh1 is the hydraulic resistance of the circular cylindrical tube 500;

Rh2 is the hydraulic resistance of the cartridge 501-508;

L1 is the length of the circular cylindrical tube 500;

L2 is the length of the body of the cartridge 501-508;

R1 is the internal radius of the circular cylindrical tube 500;

R2 is the internal radius of the cartridge 501-508.

For example, standard values for an application entailing the daily dosing of active compounds of the order of 1 ml would be to use cylindrical cartridges with a cartridge inside radius R2 of 8 mm and a cartridge body length L2 of 15 cm. That would allow each cartridge to store up to 30 ml of active compound and would provide the capacity for at least 30 days of use before the cartridges need to be replaced (and longer if several cartridges are used for each 1 ml daily dose). When a cylindrical ejection nozzle of circular cross section is used at the cartridge outlet, the standard dimensions for obtaining a dosage error very much lower than 10 μl (1%) independently of the level of filling of the cartridge would be for example to adopt a cylindrical tube of inside radius R1 equal to 800 μm and a length of this cylindrical tube equal to 1.5 cm. Specifically, the theoretical ratio of the resistances would then be Rh2/Rh1=1000, and Rh1/Rh2 would indeed be very much below a maximum acceptable error X of 1%. If the active compound has a viscosity of the order of 1400 cP (for example if the active compound is diluted in glycerol) by applying a working pressure of 2 bar, the flowrate of active principle will be of the order of 5.745 ml/min and the application of the working pressure for 10 s will allow 957.5 μl to be dosed whatever the level of fill of the cartridge with an error of less than 1% (plus or minus 9.5 μl). Finally, it is important to note that, in order to seek a high level of accuracy (for example within 1%), it will be necessary to take account of the influence of the hydrostatic pressure in the reservoirs and it will then be necessary to ensure that the working pressure is high enough in comparison with the level of hydrostatic pressure generated by the active compound in the full cartridge. Typically, if the hydrostatic pressure is of the order of 10 mB when the cartridge is full, it is necessary to operate with pressures higher than 2 bar if a precision of at least 0.5% is to be able to be achieved with the invention. For very high levels of accuracy it may therefore be sensible to choose the geometry of the cartridge in such a way that this hydrostatic pressure remains low. In the preceding example, it would be possible for example to choose a cartridge with a radius R2 equal to 2 cm and a cartridge length equal to 2.5 cm. With an active compound of a density close to 1.25 g/cm$^3$ (the density of glycerol), the hydrostatic pressure would then be of the order of 3.2 mB and it would be possible to achieve metering accuracies of 0.2% with a working pressure of 2 bar.

This difference in hydraulic resistance between the cartridge and the cylindrical tubes 500 improves the repeatability and the predictability of the injected dose, by making it possible to control the mean flowrate. Thus, the dose dispensed is directly proportional to the mean time of application of a constant pressure (see FIG. 7), independently of the fill level of the cartridge.

The higher the outlet hydraulic resistance in comparison with the hydraulic resistance of the cartridge, the less sensitive the system is to the level of fill of the cartridge and to the way in which the cream is spread out therein, and therefore the more repeatable the system.

This difference in hydraulic resistance allows the active elements A1-A2 to be ejected out of the cartridge under the effect of the applied pressure at a flowrate that is proportional to the applied pressure and to the time for which the pressure is applied, which is controlled by the opening of the associated valves in the pressure distributor. The dose administered is also proportional to the viscosity of the active elements A1-A2.

FIGS. 5, 6*a*, 6*b* and 6*c* illustrate the embodiment in which the reserves of active compounds are made up of a support 400 in which cartridges are positioned.

In FIG. 5, the support 400 comprises eight cartridges 501 to 508, viewed from above. Each cartridge comprises a body 530 (see FIG. 4) delimited by a longitudinal wall, an inlet 511 and an outlet 521.

The cartridges are advantageously placed side by side and arranged around a central axis so that all the compressed-air inlets are situated for example on the top face with respect to the direction of gravity and all the outlets are on the bottom surfaces (in the direction of gravity).

For the sake of ease of connection to the pneumatic circuit, the inlets 511, 512, 513, 514, 515, 516, 517 and 518 are arranged, in the position of use, at the periphery of the upper face of the cartridge.

FIG. 6*a* illustrates these same cartridges viewed from beneath.

According to a preferred embodiment of the invention, the cartridge outlets are positioned in the continuation of the edge corner of the cartridge that is most centrally situated in the position of use. In other words, the outlet is positioned in the continuation of a longitudinal wall of the body 530 of the cartridge. In this way, in use, the N outlets 521-528 together form a single distribution nozzle 520 when the N cartridges are inserted in the support.

In FIG. 6*a*, the nozzle formed by the juxtaposition of the outlets 521-528 of the cartridges is circular. It is of course possible to provide a nozzle of different shape. FIG. 6*b* for example illustrates a square nozzle 520.

FIG. 6*c* illustrates an embodiment similar to that of FIG. 6*b* but with just four cartridges 501 to 504.

In one advantageous embodiment of a system for preparing and dispensing a personalized composition according to the invention, each reserve of active compound comprises a pressure sensor 360 making it possible to measure the pressure in the said reserve of active compound. When the reserves of active compound are made up of a support and of cartridges, the pressure sensors 360 are designed to measure the pressure inside or at the inlet to each cartridge 501-502.

The pressure sensors at the inlet to each cartridge improve the predictability of the dose by directly correlating the integral of the measured pressure with the administered dose, and make it possible to measure the level of fill of the cartridge by measuring the pressure rise time. This is illustrated in FIG. 8 where it may be seen that the distribution pressure (in this instance 0.8 bar) in a cartridge that is 90% full (line between squares) is reached almost immediately (200 ms), which means that the difference between the called-for dose and the administered dose is negligible (less than 10%) for injections, for example in excess of 2 seconds.

Conversely, a cartridge that is practically empty (degree of filling 20%) takes longer to reach the distribution pressure (line between triangles). In the example, the cartridge took almost 1 s to reach the distribution pressure.

That means that the dose distributed in the case of a limited-pressure generator, for an injection time of 2 s, is significantly smaller than the dose called for. This variation in the rise in pressure in the cartridge is associated chiefly with the maximum flowrate that the pressure generating system is capable of supplying. If this flowrate is not ideally infinite, the time taken for the pressure in the cartridges to rise may vary according to the volume of air that needs to be pressurized (and therefore according to the level of fill of the cartridge).

In the case of a generation system that is particularly limited with respect to the total volume that has to be pressurized, this time taken to achieve the pressure may result in a not-insignificant variation in the injected dose (for example if the pressurization time corresponds to a not-insignificant fraction of the total injection time).

By monitoring the pressure using the pressure sensors, and by calculating the integral of the pressure signal with respect to time so as to obtain the dose actually delivered, it is possible to command a longer pressurizing time so that the dose delivered is identical to the dose called for.

The system according to the invention therefore makes it possible to deliver accurate doses of active compounds whatever the level of fill of each cartridge and whatever the performance of the pneumatic pressure generator in applying the working pressure (setpoint pressure) in all the cartridges. In other words, it is possible to use pressure generators that are not very powerful and therefore not very expensive. Alternatively, for the same pressure generator, a system fitted with pressure sensors is far more accurate on small dosages than the same system without pressure sensors.

Symmetrically, the fall in pressure in the reservoirs at the end of injection can be integrated using the pressure sensors. However, since this fall in pressure is not dependent on the pressure generator, it is generally more rapid and furthermore is not dependent on the number of cartridges pressurized.

Figure 9:
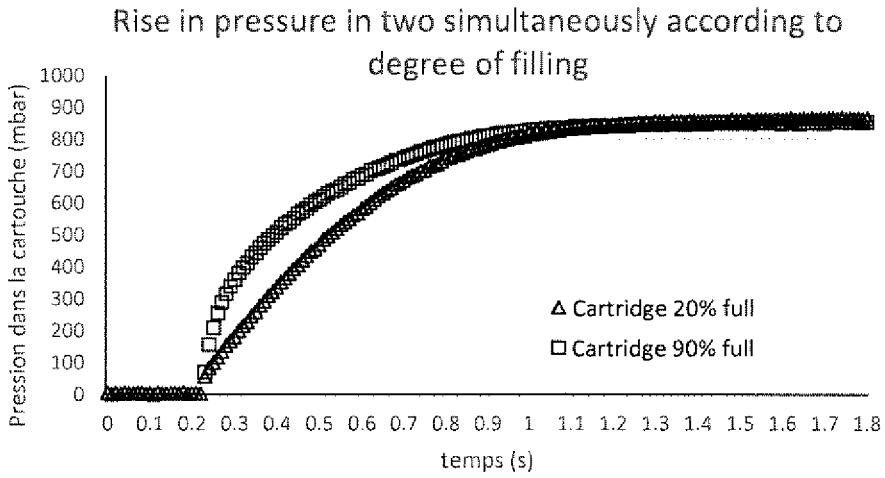
FIG. 9: a graph illustrating the duration of the simultaneous rise in pressure of two cartridges of active compound as a function of their degree of filling.

Another major advantage of inserting pressure sensors for measuring the pressure in the cartridge is that it is possible to measure the degree of fill of the cartridges and thus predict when the user will need to replace his cartridges. Without this option, it is possible that metering will be erroneous simply because the reserve of active compound is empty. In order to eliminate this problem, it is possible to make use of the information generated by the pressure sensors. Specifically, the speed at which the cartridges become pressurized or depressurized is dependent on the volume of cream remaining in each cartridge. The greater this volume, the more rapid the pressurization and depressurization phases. In the case of an imperfect pressure generator, it may nevertheless happen that the curves expressing rise in pressure will be dependent on the number of cartridges pressurized because the flowrate that the generator will supply to each pressurized cartridge will be dependent on the maximum flowrate of this pressure generator divided by the number of cartridges pressurized simultaneously. FIG. 9 illustrates the rise in pressure in two cartridges pressurized simultaneously under the same conditions as in FIG. 8 (cartridges with a respective degree of fill of 90% and 20%). It may be seen in this figure that, for each cartridge, the pressurizing time has been lengthened even though it is still possible to determine which cartridge is fuller than the other. In order to take account of this way in which the shape of the cartridge pressure rise is dependent on the performance of the pressure-generating system and on the number/level of fill of the cartridges used, it may be beneficial to insert a flow limiter either at the inlet I1 or at the outlet 311-316 of the pressure changeover switches (or at the outlet O1 of a potential 2:2 valve with which the pressure changeover switch may be equipped) so that the maximum flowrate of the pressure generator is equal to at least N times the limited flowrate for each cartridge. Thus, the shape of the pressure rise will no longer be limited by the maximum flowrate of the pressure generator.

Thus, when the system comprises pressure sensors in the reserves 501-508 of active compounds, the method may comprise a step of determining the degree of filling of at least one reserve of active compound 501-508, comprising:

recording the curve of pressure measured by the pressure sensor as the pressure in the said reserve 501-508 of active compound rises and/or falls; and calculating the degree of filling of the said reserve 501-508 of active compounds by comparing the curve of pressure thus measured against reference curves for the rise and/or fall of pressure in reservoirs having different degrees of filling.

However, if the pressure-generating system experiences a degradation in performance over time, it is possible that the shape of the pressure rise curves will vary progressively with this ageing. An alternative solution for being able to measure the fill level of the cartridges in such a case is to insert in the supporting structure 100 a series of N' (N' greater than or equal to 1) reference reservoirs of predefined volumes (for example 5 ml, 10 ml, 15 ml and 18 ml), each one of them being associated with a valve situated at the level of the pressure distributor and having an associated pressure sensor. By measuring the rise in pressure in these reference reservoirs for each pressurization, it will be possible to compare the curves of rise in pressure in the cartridges against these reference reservoirs and thus determine the volume with which the cartridge is filled. For example, in the case of the use of 20 ml cartridges in the invention, if the curve of the rise of pressure in a cartridge is comprised between the curve showing the rise in pressure of the 10 ml reservoir and that of the 15 ml reservoir, the system will be capable of predicting that between 10 and 15 ml remain in the cartridge and that it is necessary for example to order a new cartridge. If the curve of the rise in pressure is slower in the cartridge than for the 18 ml reference reservoir, the system will be able to determine that the cartridge is almost empty and that this cartridge needs to be changed.

Another advantage of being able to measure the degree of filling of the cartridges is that of being able to diagnose potential blockages of the ejection nozzles. Specifically, by integrating all of the doses injected since the cartridge was fitted and by measuring the actual level of the cartridges, it is possible to detect a significant difference between the amount of cream theoretically remaining in the cartridge (from the sum of the dispensed doses) and the quantity of cream actually remaining in the cartridge (from measuring the rise in pressure in the cartridge). It will thus be possible to alert the system or the user that a cartridge is no longer dispensing the correct level of product, for example because the user has let the active compound dry out and thus block the ejection nozzle.

Figure 10:
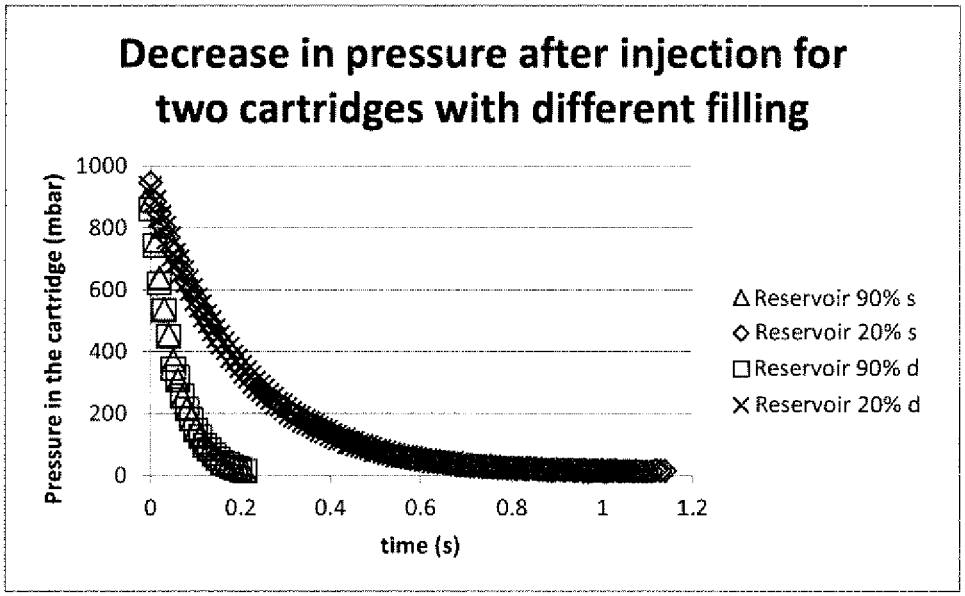
FIG. 10: a graph illustrating the duration of the fall in pressure of two cartridges of active compound as a function of their degree of filling for consecutive or simultaneous depressurization.

Alternatively, the level of fill of the cartridge can be measured during the depressurization of the cartridges. If a flow limiter is inserted between the cartridge and the air outlet to atmospheric pressure, the depressurization time will be dependent on the flow limiter, on the empty volume in the cartridge and on the max difference in pressure in the cartridge during the injection phase and atmospheric pressure. FIG. 10 shows the decrease in pressure in the cartridge when an air filter used as a flow limiter is inserted between the cartridge and the atmospheric air outlet. In this configuration, the pressure decrease curve becomes independent of the number of cartridges pressurized because these circuits become independent, whereas in the pressure rise phase, the pressurization is dependent on the generation system common to all the cartridges and therefore on its capacity to deliver an air flowrate that is constant irrespective of the number of cartridges pressurized (or of the level of fill of the cartridges). In such cases, it will nevertheless be recommended to use N+N' identical flow limiters on the atmospheric inlet E2 of each changeover switch so as to ensure that the pressure discharge dynamic is identical in all the reservoirs (active compound and reference reservoirs). This embodiment therefore makes it possible to determine the degree of fill independently of the performance of the pressure-generating system and therefore makes it possible to avoid the use of the reference volumes by using a simple initial calibration of the time that an empty cartridge and the time that a full cartridge take to depressurize.

However, estimating the level in the cartridge during the pressure rise phase and the pressure fall phase is of benefit in diagnosing correct system operation. It might therefore be desirable to combine the measuring of the time taken to fill the cartridge during pressurization, for example using reference reservoirs, and the measurement of the depressurization time, for example using identical flow limiters for each N+N' changeover switch. In the event of different filling measurement values during the diagnosis of an active compound reservoir, it will be possible from this to deduce that there is a problem with system sealing: indeed a cartridge that has not been inserted with proper sealing will take longer time to achieve pressure, whereas its drop in pressure will be more rapid compared with the same cartridge hermetically sealed. In the event of a significant change to the rise time for all the reference reservoirs, it will be possible from this to deduce a degradation to the pressure-generation system which may need replacing. In the event of changes to the depressurization curves for the reference reservoirs, it will be possible from this to deduce fouling or degradation of the performance of the flow limiters, also requiring these to be replaced.

Figure 11:
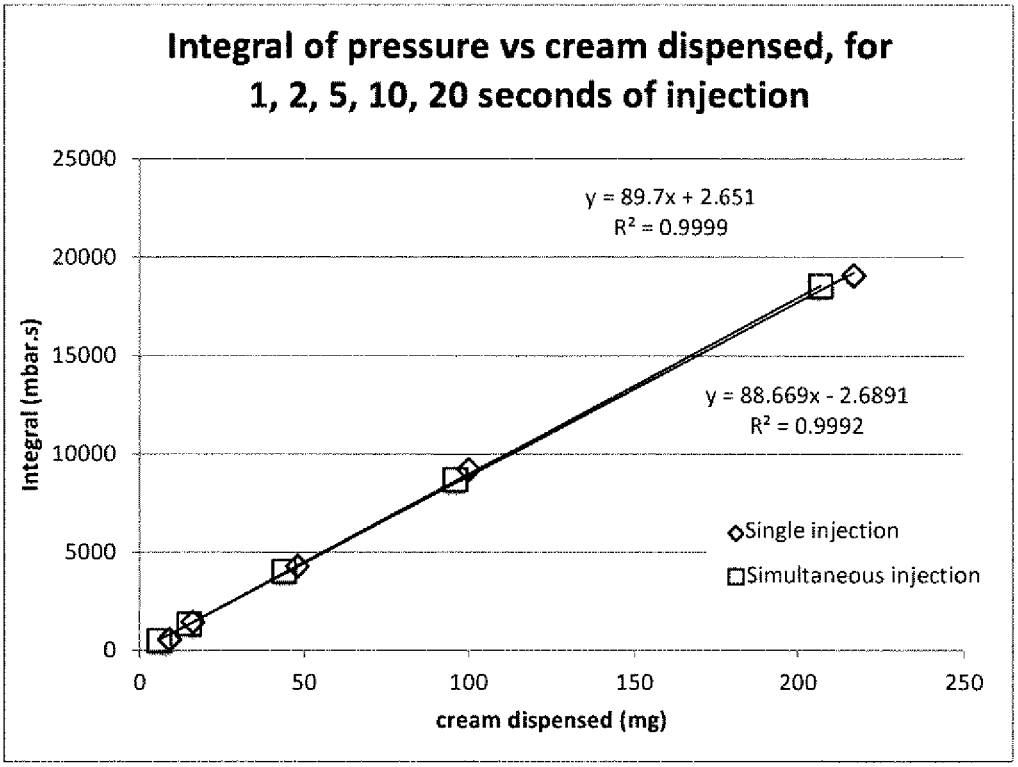
FIG. 11: a graph illustrating the correlation between the injected dose and the integral of the pressure in a cartridge in the case of a limit-pressure-generation system, for injection from a single cartridge or for simultaneous injection from several cartridges.

All these diagnostic capabilities are essential for allowing accurate metering of the active compound whatever the state of ageing of the system. FIG. 11 finally illustrates, in the case of an imperfect pressure-generation system made up of a low output pneumatic pump and in a system in which a flow limiter has been introduced between the pressure distributor and each cartridge, the influence on the time taken for the pressure to rise and to decrease for various injection times (1, 2, 5, 10 and 20 s) according to whether the cartridge is pressurized singly (diamond) or whether several cartridges are pressurized simultaneously (squares).

When the cartridges are pressurized simultaneously, because the rise in pressure is slower, the measured injected dose is slightly smaller than the injected dose when the cartridge is pressurized singly (the variation is of the order of 10%). Nevertheless, it is also found that the injected dose is precisely proportional to the integral of the pressure in the cartridge with a linear regression coefficient of determination greater than 0.999. The injected dose can therefore be improved significantly with this measurement of pressure in the cartridge whatever the limits imposed by the pressure generator or the flow limiters needed for example for measuring the degree of filling of the cartridges. For that, it will nevertheless be necessary to calibrate the system beforehand in order to know the value of the hydraulic resistance Rh1 for the active compound dispensed by measuring the flowrate of active compound induced by the working pressure when the active compound completely fills the ejection nozzle.

Thus, when the system comprises an ejection nozzle the hydraulic resistance Rh1 of which is at least nine times higher than the hydraulic resistance Rh2 of the said reserve of active compound (Rh1 being known from prior calibration of the system) and pressure sensors in the reserves 501-508 of active compounds, the method for preparing and dispensing a personalized composition according to the invention further comprises a step of determining the degree of filling of at least one reserve of active compound 501-508, comprising:

recording the curve of pressure measured by the pressure sensor as the pressure in the said reserve 501-508 of active compound rises, stabilizes and falls;

integrating, with respect to time, the pressure thus measured; and calculating the injected dose by dividing the integral thus obtained by the hydraulic resistance Rh1 previously measured during system calibration.

When the reserves of active compounds are made up of a support and cartridges, the cylindrical tubes 500 are advantageously arranged directly at the outlet of each cartridge. Thus, it is the cartridge itself that bears the cylindrical tube. Such an embodiment is illustrated in FIG. 6.

In this example, the cylindrical tube 500 has a cross section S1 preferably smaller than 1 $mm^2$ and of a length preferably greater than 1 mm.

According to the invention, the reserve of active compound has a cross section 52 and a length L2 such that its hydraulic resistance Rh1 is greater than Rh2, preferably at least 9 times greater. This makes it possible to ensure that the greater or lesser filling of the cartridge will have a mere 10% influence on the flowrate of active compound dispensed. If the ratio between Rh1 and Rh2 is 100, the filling of the cartridge may have of the order of 1% influence on the metering flowrate (between cartridge full and cartridge empty).

The inlet 511 of the reserves of active compounds must also have a low hydraulic resistance in order to allow the cartridge to be pressurized rapidly. For example, the inlet 511 may have a circular cross section S3 with a diameter of 1 cm and a length of 2 cm, whereas the outlet 521 has a cross section S1 with a diameter of 0.5 mm and a length of 1 cm. These dimensions are particularly well suited to the case, for example, of cosmetic creams.

The lower the viscosity and the higher the density of the active compound, the smaller needs to be the choice of cross section S1 and the greater the choice of length L1 in order to obtain a high resistance Rh1 and limit the influence of hydrostatic pressure on metering. For a liquid having the density and viscosity of water in a cartridge 10 cm tall (hydrostatic pressure of 10 mbar), a cross section S1 of diameter 100 μm and of length 1 cm will make it possible to limit leaks associated with the action of gravity to 15 μl per minute, whereas the application of a pressure of 2 bar will allow the metering of around 50 μl/s (3000 μl/min).

An alternative solution for limiting the influence that this leakage under gravity has on metering when the cartridge is not pressurized is not to place the cartridge in open connection with atmospheric pressure but rather to "plug" the outlet at the pressure distributor. That can be obtained by adding a 2:2 valve between the reserve of active compound and, for example, directly at the inlet I2 (see FIG. 2*b*) or alternatively at the outlet 311-316 (FIG. 2*c*). This valve, when closed, combined with the small diameter of the cylindrical tube 500, will make it possible to prevent the liquid from spilling out.

Another alternative solution for limiting leaks under gravity when no cartridge is in use is to add an automatic shutoff at the outlet of the cartridges. This shutoff may be made up of a flexible (which means to say readily deformable) nozzle that is closed off automatically by a clamping system before and after dispensing. Advantageously, this type of flexible nozzle can be cleaned/replaced more easily if certain active elements should dry out in the end of the dispensing nozzles. In the case of most viscous fluids (for example those having viscosities 10 times higher than water, the use of a flexible bung fitted by the user will suffice).

Alternatively, the cylindrical tubes 500 are arranged on the support 400 itself such that, in use, they are arranged downstream of the outlet of the cartridges and are designed to be held hermetically, in use, against each cartridge outlet. However, in that case, it will be necessary to clean the support after use, unless the active compound in the replacement cartridge is the same.

Alternatively, the reserves of active products are contained directly inside the support 400 such that, in use, the active products are introduced directly by the user when they become short. However, in this case, the user will be restricted to the use of the same active ingredients for which the resistance Rh1 of the reservoir and Rh2 of an ejection nozzle that might be contained by the supporting structure 100 will have been characterized beforehand.

Because of the use of pressurized injection and because of the viscosity (generally between $10^{-3}$ Pa·s and $10^{3}$ Pa·s) of the active compounds (particularly of the excipients generally used to contain the active compounds), the presence of a bubble in the products has only a very negligible influence on the dose actually delivered.

Specifically, if there is a bubble in the preparation containing the active compound or compounds, this bubble will flow far more quickly through the cylindrical tube 500 than will the liquid. All liquids have a viscosity at least fifty times higher than the viscosity of air at 20° C. What that means is that a bubble of the order of magnitude of the dose administered will be ejected in at most 1/50th of the time needed for metering the liquid, and will therefore not significantly disturb the dose. Specifically, the presence of a bubble of the order of magnitude of the dose to be dispensed will disturb the dose by just 2% at most). In the case of positive displacement metering of the prior art mentioned hereinabove (the use of syringe drivers or mixing cylinders) on the other hand, the presence of a bubble of a size equivalent to the dose to be administered may, in the worst case, lead to a 100% disturbance in the dose (only the bubble will be injected, and no active ingredient).

It should also be noted that, in the exemplary embodiments illustrated and described, the reserves of active product and the cylindrical tubes 500 have cylindrical shapes that have the advantage of allowing easy calculation of the hydraulic resistance. However, this feature is nonlimiting and any shape of reserve for active product or ejection nozzle possibly having restrictions, structures or bulges inside, may be used so long as the stipulation, whereby the hydraulic resistance induced by the reservoirs Rh2 is known and that the resistance Rh1 of the ejection nozzles is higher than Rh2, preferably at least nine times higher, is met. It is important to note that the ratio of the hydraulic resistances can easily be measured by measuring the flowrate D1 generated by a given pressure difference DeltaP applied to a liquid (for example water) completely filling the cylindrical tubes 500 and the flowrate D2 generated by the same pressure difference DeltaP applied to this same liquid completely filling the reserve of active compound. This will then give Rh1/Rh2=D2/D1. There is therefore no need to be able to calculate the hydraulic resistance a priori and only the ratio of hydraulic resistance, which can be calculated for any arbitrary liquid, is of importance.

In order to be able to measure these flow resistances Rh1 and Rh2, it is preferable for the body of the reserve of active compound and the ejection nozzle to be nondeformable under the application of the working pressure. Specifically, if the materials and/or the dimensions (notably the thickness) of these elements make them deformable at the working pressure, the flow resistance could vary as the pressure in the reservoir rises and the ratio between Rh1 and Rh2 could likewise also vary according to the deformation of the elements used as caused by the working pressure. For example, the use of a body made of glass or of steel of sufficient thickness will make it possible to obtain hydraulic resistances that remain constant whatever the working pressures used up to 2 bar.

In general, the cartridges need to be in such a position that active compound is always in contact with the ejection nozzle so that pressurization culminates in the ejection of active compound and not in the ejection of air. In practice, it is relevant to use gravity to ensure that the active compound is always in contact with the nozzle. In that case, the support needs to make it possible to hold the cartridges in such a way that the fluid outlet is below the fluid inlet (within the direction of gravity). Thus, in the foregoing exemplary embodiments, the active compound(s) is/are contained in a rigid active compound reserve (which means to say one that does not deform during pressurization). In this case, the support needs to allow the cartridges to be held substantially vertically (in the direction of gravity) to within plus or minus 45 degrees, so that gravity pulls the preparation towards the ejection nozzle 500. Specifically, it is preferable for the ejection nozzle to be situated below (in the direction of gravity) the reserve of active compound. Likewise, in order to avoid overspilling of liquid in the pressure distributor 300, it is preferable for the inlet 511 of the reserves of active compound to be situated above (in the direction of gravity) the reserve of active compound.

According to one alternative embodiment (not illustrated) of the invention, each cartridge comprises an exterior wall that is nondeformable by the pressure during operation, and an internal chamber that is deformable under the pressure and comprises the active compound(s) in a liquid. For example, the cartridge is made of metal and a flexible chamber is a flexible bag made of plastic polymer.

The flexible (which means to say deformable under the application of pressure) chamber is hermetically attached (by fusion bonding, adhesive bonding or clamping) to the ejection nozzle (for example the cylindrical tube) 500 so as to allow the liquid to escape under the effect of the pressure applied to the walls of the flexible chamber.

In this way, it is possible to have cartridges the ejection nozzle of which is higher up than the air inlet because the air will never escape through the ejection nozzle which is hermetically sealed to the flexible chamber and the active compound will not spill over into the pressure distributor because it is enclosed by the flexible chamber.

This operation also makes it possible to limit problems of contamination by the injected air and allows the system to operate with cartridges that are not vertical. By preventing the active compounds from degrading over the course of time, it then becomes possible to use accurate dosing of active compounds over far longer periods (of several months) than in the case where the active compounds are not protected from processes of chemical modification caused by exposure to air. By contrast, the use of a flexible chamber may have the effect of increasing the hydraulic resistance Rh2 of the reservoir by an additional resistance Rh2', particularly when the quantity of liquid becomes small and when a not-insignificant amount of mechanical work becomes necessary to bend the flexible chamber. This resistance Rh2' is dependent on the fill level of the flexible chamber and tends towards infinity as the reserve of active compound tends to empty. Specifically, this resistance Rh2' can be evaluated in the same way as Rh1 and Rh2 by measuring the flowrate generated for a given liquid when a given pressure is applied to the chamber. It will therefore be necessary to be sure during use always to keep the ratio between Rh1 and Rh2+Rh2' higher than 9 (or higher than the inverse of the level of error that is acceptable for the metering flowrate). In order to do that, it is necessary to know the value of Rh2' for a certain critical level of fill of the cartridge (for example when it is now full only to 10% of its total capacity), to dimension Rh1 at least nine times higher than the sum Rh2+Rh2' and to be sure to change the reservoir of preparation when the reservoir has reached the critical degree of filling, namely before this mechanical work significantly disturbs the metering system and the proportionality between the pressure applied and the flowrate of preparation dispensed.

It should also be noted that, in the case of the use of a flexible chamber hermetically sealed to the cylindrical tube, a loss of liquid which remains trapped in the folds of the flexible chamber may occur. For this reason, in this alternative embodiment, it will be sensible to suspend the dispensing of liquid when the reserve of compound has reached a critical degree of filling, for example 10%.

Once it has passed the outlet of the cartridges, the product is delivered in the form of a juxtaposition of droplets of active products into the cupped hand of the user or into a cup acting as a receptacle. The user then need do nothing more than mix the preparation before applying it if, for example, it is a cosmetic preparation, or dilute it in a potable liquid if, for example, it is a medicinal formulation or food supplement, or then mix it manually with a stick if it is, for example, a tint, a paint, a glue or a resin. The user can then temporarily store his preparation thus mixed in a container intended for subsequent use or administration of the preparation.

According to some embodiments which are not illustrated:

the valves 301 to 306 may be replaced by a pressure regulating system, in the example given, comprising N pressure regulators, for example made up of an electronically regulated proportional valve such as the PRE-U model sold by the company HOERBIGER. The advantage of this configuration is that the injection can be regulated by varying the pressure in each cartridge independently, as well as by varying the metering time. This becomes all the more important when the accuracy of the metering is to be improved still further. For example, if a 3:2 valve is used to switch over the pressure in the pressure distributor and this valve has a response time of the order of 50 ms, but there is an uncertainty of 10 ms on whether the valve is opened or closed, if the flowrate of active compound is of the order of 1 ml per second for a working pressure of 1 bar generated by the pressure generator, then the uncertainty as to whether the valve is opened/closed will generate an uncertainty of the order of 10 μl on the dosage. If, instead of using a simple 3:2 valve, use is made of a pressure regulator, it will be possible in this case to work at a lower pressure in the reserve of active compound and thus reduce the uncertainty associated with the delay in switchover associated with the valves (or with the control electronics). For example, by operating at a pressure of 100 mbar, a temporal uncertainty of 10 ms will then result in a metering uncertainty of just 1 μl (as the metering flowrate has been reduced by a factor of ten). The engineer will therefore prefer to replace 3:2 valves with pressure regulators for reserves of active compound that need to have a lower metering error associated with the switchover delays. He will thus be able progressively to reduce the pressure in the reserve of active compounds when, for example, he reaches 90% of the injected dose.

In order to get around the output limit of the pump which could limit the rise in pressure during the opening and closing of the valves, an intermediate reservoir of a capacity preferably higher than the sum of the volumes of the cartridges will make it possible to store the compressed air used for pressurizing the cartridges (for example a volume of 250 ml for four cartridges each of 30 ml). This reservoir is positioned before the pressure reducer and if there is a desire to operate at a pressure of 1 bar in the cartridges, all that is required is to have a stored pressure higher than 2 bar in the reservoir to ensure that the pump will be unnecessary (and therefore will not be limiting) in the pressure rise phase. For example, a pressure-generating system made up of a pump which when in operation works at a pressure X times higher than the maximum working pressure and of a reservoir of a capacity 1/(X−1) times the total capacity of the cartridges will allow the cartridges to be pressurized independently of the maximum output of the pump. This embodiment allows us therefore to make the system independent of the maximum output of the pump.

By inserting flow limiters upstream of the reserves of active compounds it is possible to make the pressure-rise curves independent of the number of cartridges in use (the flowrate of air during pressurization being able to be higher in instances in which just one single cartridge is being pressurized rather than six) and makes the prediction using the pressure sensors simpler and more repeatable.

The system according to the invention is therefore accurate because the time taken to pressurize the reserves of active compounds can be modulated according to the filling of the reserves of active compounds.

It is also simple and hygienic because there is no need to wash the pneumatic circuit. The compounds are preferably stored in replaceable cartridges the outlet of which constitutes the end of the fluid circuit. There is therefore no product to foul the system.

Furthermore, it is inexpensive, rapid and not very bulky because the components are inexpensive and relatively miniaturized by comparison with the syringe drivers of the prior art.

The system according to the invention therefore allows the user accurately and extemporaneously to dispense and manufacture at home or at the place of consumption bespoke consumable products such as cosmetic products, pharmaceutical, medical or nutritional formulations, or even mixtures of the paint, resin, tint type or even culinary preparations (mixtures of flavours).

The system according to the invention is able to accept external data able to modify the composition of the product ultimately prepared, for example according to the weather: in the case of a cosmetic cream, it will be possible, for example, to increase the addition of ultraviolet filters in the event of sunshine, or of moisturizer in the event of wind.

In the medical field, the external data may refer for example to data derived from biometric sensors (pulse rate, amount of sleep, level of activity), from diagnostic systems (system that measures blood sugar levels, blood pressure), individual questionnaires gathered by remote software (pain or discomfort felt), etc.

The invention claimed is:

1. A preparation and dispensing system for preparing and dispensing a personalized composition from N reserves (501-508) of active compounds (A1-A2), N being an integer greater than or equal to 1, each of the reserves having a hydraulic resistance (Rh2) and each of the reserves comprising a fluid inlet (511-518), a fluid outlet (521-528) and a body (530) comprising at least one active compound, the system comprising a pneumatic-pressure generator (200, 201-202) connected to a pressure distributor (300) comprising N pressure changeover switches (301-306), each N pressure changeover switch having at least one inlet (I1) connected to the pneumatic-pressure generator, one inlet (I2) connected to atmospheric pressure and an outlet (311-316) connected to the fluid inlet of one of the reserves of active compounds (A1-A2), such that each reserve (501-508) of active compound (A1-A2) can be placed in communication either with atmospheric pressure, or with pressure generated by the pneumatic-pressure generator, and in that each of the reserves of active compound comprises, at the fluid outlet of each of the reserves, an ejection nozzle (500), a hydraulic resistance (Rh1) of which is higher than the hydraulic resistance (Rh2) of each of the reserves of active compound, wherein each of the reserves of active compound is made up of an interchangeable multi-dose cartridge (501-508) and of a cartridge support (400) designed to keep, in use, hermetically and independently, each inlet of each interchangeable multi-dose cartridge with each outlet of each of the pressure changeover switches.

2. The system according to claim 1, wherein the hydraulic resistance (Rh1) of the ejection nozzle is at least nine times higher than the hydraulic resistance (Rh2) of the reserve of active compound.

3. The system according to claim 1, wherein the ejection nozzle is a cylindrical tube (500).

4. The system according to claim 1, wherein each of the pressure changeover switches (301-306) is a 3:2 valve.

5. The system according to claim 1, wherein each of the pressure changeover switches (301-306) is a pressure regulator.

6. The system according to claim 1, wherein each of the ejection nozzles (500) is arranged directly at the outlet of each interchangeable multi-dose cartridge.

7. The system according to claim 1, wherein the ejection nozzles (500) are arranged on the cartridge support in such a way that, in use, the ejection nozzles are arranged downstream of the outlet of each of the interchangeable multi-dose cartridges, and are designed to be held hermetically, in use, against each outlet of the interchangeable multi-dose cartridge.

8. The system according to claim 1, in which the pneumatic-pressure generator is made up of a pump (201) connected to a pressure reservoir (202), the pressure reservoir connected to a pressure reducer (203) allowing a pressure reservoir outlet pressure to be regulated.

9. The system according to claim 1, in which the pneumatic-pressure generator is made up of a removable and interchangeable compressed-gas reservoir associated with a pressure reducer.

10. The system according to claim 1, in which the inlet (2) of at least one of the pressure changeover switches (301-306) is connected to an outlet (O1) of a 2:2 valve (301'-306'), the 2:2 valve further comprising a controllable-opening inlet (I3) connected to atmospheric pressure such that at least one of the reserves (501-508) of active compounds (A1-A2) can be either placed in communication with atmospheric pressure, or placed in communication with the pressure generated by the pressure generator, or closed.

11. The system according to claim 1, in which the outlet (311-316) of at least one of the pressure changeover switches (301-306) is connected to a controllable-opening inlet (I3) of a 2:2 valve (301'-306'), the 2:2 valve further comprising an outlet (O1) connected to one of the reserves (501-508) of active compounds (A1-A2), such that at least one of the reserves (501-508) of active compounds (A1-A2) can be either placed in communication with atmospheric pressure, or placed in communication with the pressure generated by the pressure generator, or closed.

12. The system according to claim 1, comprising N pressure sensors (360), each N pressure sensor arranged in one of the reserves of active compounds, allowing pressure in the N reserves of active compounds to be measured.

13. The system according to claim 1, wherein a flow limiter is arranged between the pressure generator and each inlet (I1) of the N pressure changeover switches.

14. The system according to claim 1, wherein a flow limiter is arranged between atmospheric pressure and each inlet (I2) of the N pressure changeover switches.

15. The system according to claim 1, wherein a flow limiter is arranged between each reserve of active compounds and each outlet (311-316) of the N pressure changeover switches.

16. The system according to claim 12, further comprising N' reference reservoirs which are hermetic and nondeformable in operation under pressure and have known and mutually different volumes, N' being greater than or equal to 1, the pressure distributor having N' additional pressure changeover switches connected to the N' reference reservoirs and each N' additional pressure changeover switch comprising a pressure sensor allowing pressure internal to each N' reference reservoir to be measured.

17. The system according to claim 16, in which N+N' identical flow limiters are arranged between the pressure generator and each inlet (I1) of the N+N' pressure changeover switches.

18. The system according to claim 16, additional pressure changeover switch N+N' identical flow limiters are arranged between atmospheric pressure and each inlet (I2) of the N+N' pressure changeover switches.

19. The system according to claim 16, additional pressure changeover switch N+N' identical flow limiters are arranged between each reserve of active compounds and each outlet (311-316) of the N+N' pressure changeover switches.

20. A cartridge for the preparation and dispensing system according to claim 1, characterized in that the cartridge further comprises a body (530), an inlet (511) and an outlet (521) fitted with an ejection nozzle (500), the hydraulic resistance of the ejection nozzle being at least nine times higher than a hydraulic resistance of the body (530).

21. The cartridge according to claim 20, wherein the body (530) is delimited by a longitudinal wall, the ejection nozzle being positioned in a continuation of the longitudinal wall of the body (530) of the cartridge such that, in use, when several cartridges are juxtaposed, outlets of the cartridges together form a single distribution nozzle.

22. The cartridge according to claim 20, comprising an exterior wall that is nondeformable by pressure in operation, and an internal chamber comprising the active compound(s), the internal chamber being deformable under the pressure in operation and being intended to be fixed in a sealed manner to the ejection nozzle (500) in a position of use.

23. A method for preparing and dispensing a personalized composition from the reserves (501-508) of active compounds (A1-A2) of the system according to claim 1, characterized in that the method comprises the following steps:

a) activating the pneumatic-pressure generator (200, 201-202) to deliver a working pressure;

b) controlling activation of at least one of the N pressure changeover switches (301-306) for a determined duration so as to deliver a working pressure for a given time to at least one reserve of active compound and deliver, for each active compound (A1-A2), a dose determined according to the working pressure;

c) at the end of each determined duration, controlling activation of at least one of the N pressure changeover switches (301-306) to deliver atmospheric pressure to the at least one of the reserves of active compounds in order to stop flow of the active compound out of the at least one reserve.

24. The method according to claim 23, in which, during step b), a duration for which each of the active compounds (A1-A2) is dispensed is recorded, a quantity of active compound dispensed from each of the reserves (501-508) then being deduced and used to determine a fill status for each of the reserves (501-508), the method further comprising a step d) of indicating a need to refill one or more of the reserves (501-508).

25. The method according to claim 23, wherein for each ejection nozzle, a hydraulic resistance (Rh1) is at least nine times higher than the hydraulic resistance (Rh2) of the said reserve of active compound, and the system comprises pressure sensors in the reserves (501-508) of active compounds, the method further comprising a step of determining the dose of active compound dispensed, comprising:

recording a curve of pressure measured by the pressure sensor as pressure in the said reserve (501-508) of active compound rises, stabilizes and falls;

integrating, with respect to time, the pressure thus measured;

calculating an injected dose by dividing an integral thus obtained by the hydraulic resistance (Rh1).

26. The method according to claim 23, wherein the system comprises pressure sensors in the reserves (501-508) of active compounds, the method further comprising a step of determining a degree of filling of at least one reserve of active compound (501-508), comprising:

recording a curve of pressure measured by the pressure sensor as pressure in the reserve (501-508) of active compound rises and/or falls;

calculating a degree of filling of the reserve (501-508) of active compounds by comparing a curve of pressure thus measured against reference curves for the rise and/or fall of pressure in reservoirs having different degrees of filling.

27. The method according to claim 23, wherein the system comprises pressure sensors in the reserves (501-508) of active compounds, and N' reference reservoirs, the N' reference reservoirs also fitted with pressure sensors, the method further comprising a step of determining a degree of filling of at least one reserve of active compound (501-508), comprising:

recording a curve of pressure measured by the pressure sensor as pressure in the said reserve (501-508) of active compound rises and/or falls;

recording a curve of pressure measured by the pressure sensor as pressure in each reference reservoir rises and/or falls;

calculating a degree of filling of the said reserve (501-508) of active compounds by comparing curves of the rise and/or fall of pressure in the said reserve (501-508) of active compound against curves of the rise and/or fall of pressure in the reference reservoirs.

* * * * *